US007249726B2

(12) United States Patent
Kotzur

(10) Patent No.: US 7,249,726 B2
(45) Date of Patent: Jul. 31, 2007

(54) PROGRAMMED DENSITY OF WOUND COILS

(75) Inventor: Frank W. Kotzur, Carmel, NY (US)

(73) Assignee: Reelex Packaging Solutions, Inc., Patterson, NY (US)

( * ) Notice: Subject to any disclaimer, the term of this patent is extended or adjusted under 35 U.S.C. 154(b) by 0 days.

(21) Appl. No.: 10/949,816

(22) Filed: Sep. 27, 2004

(65) Prior Publication Data

US 2006/0071115 A1 Apr. 6, 2006

(51) Int. Cl.
*B65H 55/04* (2006.01)

(52) U.S. Cl. ..... 242/178; 242/478.2; 242/901

(58) Field of Classification Search ..... 242/171, 242/178, 362, 470, 477.6, 478.2, 480.9, 901
See application file for complete search history.

(56) References Cited

U.S. PATENT DOCUMENTS 3,747,861 A * 7/1973 Wagner et al. ..... 242/476.9
4,406,419 A * 9/1983 Kotzur ..... 242/482.6
4,523,723 A * 6/1985 Kotzur ..... 242/476.7
5,470,026 A * 11/1995 Kotzur ..... 242/478.2

* cited by examiner

*Primary Examiner*—Patrick Mackey
*Assistant Examiner*—William E Dondero
(74) *Attorney, Agent, or Firm*—Intellectual Property Law Firm of R. J. Lasker, Esq.

(57) ABSTRACT

Apparatus and process for winding filamentary material in a figure 8 configuration including a rotatable spindle for retaining a mandrel upon which the filamentary material is wound; a traverse mechanism for controlling the laying of wound coils on the mandrel; and controlling the advance of the wound layers on the mandrel in accordance with the rotation of the spindle and the movement of the traverse mechanism to vary the angular displacement of the wound coil so that the number of crossovers of succeeding layers of the wound coils increases as the winding process progresses, thereby increasing the density of the wound coils.

14 Claims, 6 Drawing Sheets

PROGRAMMED DENSITY OF WOUND COILS

BACKGROUND OF THE INVENTION

1. Field of the Invention

The invention relates to method and apparatus for the winding of coils of filamentary material in a figure 8 winding configuration and, more particularly, to such method and apparatus in which the density of the wound coil or package is controlled to increase the density of the wind. The invention has application to figure 8 winding configurations and in particular to figure 8 winding configurations of filamentary material in which a radial hole (payout hole) is produced from the innermost wind to the outermost wind, thereby enabling the filamentary material to be withdrawn from inside the wound coil through the payout hole to eliminate kinking or bird-nesting of the filamentary material as it is paid out. The winding techniques are known in the winding trade as REELEX® or REELEX II® winding processes and are the subject of trademark and patent protection by Windings, Inc., the assignee of the present invention.

2. Related Art

Known technology for winding filamentary material in a figure 8 configuration on a mandrel produces figure 8 coils substantially evenly spaced radially around the mandrel. Each layer of the wound coil is produced by advancing the figure 8s in either a plus direction (plus ADVANCE or upper ratio), or in the minus direction (minus ADVANCE or lower ratio). A plus or negative ADVANCE refers to changing the speed of rotation of the mandrel with respect to the movement of the traverse which is feeding the filamentary material to the mandrel. This concept was introduced as early as 1956 in U.S. Pat. No. 2,767,938; Taylor, Jr.; "Winding Flexible Material"; assigned to Windings, Inc. the assignee of the present invention.

The ADVANCES have also been referred to as "gear ratios", which can be actual mechanical gears (prior technology), or more recently, "electronic gears". In the latter method, for example, computer-generated signals control the rotation of the spindle on which the mandrel is mounted with respect to the movement of the traverse to obtain the desired ADVANCE. The wound layers of filamentary material are produced by alternating between the aforementioned positive or negative ratios. In the REELEX® or REELEX II® winding technique of Windings, Inc. a portion of the wound coil is devoid of the figure 8s to generate the aforementioned radial payout hole for deploying the wound filamentary material.

In prior or known winding techniques the ADVANCES are set and remain fixed throughout the production of the entire wound coil. Because the number of figure 8s in each layer is constant (in alternating layers) it is apparent they are spaced circumferentially further apart as the coil diameter increases as the winding process continues. This has the effect of decreasing the density of the wound coil as the diameter of the coil increases. For example, if the figure 8s are spaced 36 degrees apart in one of the layers (10 figure 8s in the particular layer), the figure 8s will be approximately 2.4 inches apart (along the circumference of the wind) on the surface of a mandrel that is 8 inches in diameter. The figure 8s will be 4.8 inches apart when the coil reaches 16 inches in diameter and 6.6 inches apart when the coil reaches 21 inches in diameter. A similar result is of course obtained with other spacing of the figure 8s and mandrels of different diameter.

SUMMARY OF THE INVENTION

The present invention produces windings of filamentary material in a figure 8 configuration using programmed winding techniques resulting in windings having increased density over figure 8 windings using prior art winding techniques, thereby enabling substantially more filamentary material to be wound for the same diameter of filamentary material wound with prior art winding techniques.

It is a feature of the present invention to program the radial spacing of the figure 8 crossovers in a figure 8 winding configuration of filamentary material such that the number of figure 8 crossovers is increased per layer of wound coil, whereby the density of the wound coils is increased.

It is an advantage of the present invention that increasing the density of a wound coil provides a smaller diameter coil for a given length of filamentary material. Alternatively, a significant increase in the length of filamentary material can be wound in a figure 8 configuration for a given diameter of wound coil or a smaller diameter for a given length of FM.

It is a further object of the present invention to provide a package of filamentary material wound in a figure 8 configuration and wherein the number of crossovers of the filamentary material in succeeding layers increase so that the density of the wound coil increases with increasing diameter of the package, whereby the length of material wound for a given diameter of the package is greater than if the number of cross-overs remained constant.

BRIEF DESCRIPTION OF THE DRAWINGS

The above objects, features and advantage of the invention are readily apparent from a consideration of the following description of the best mode of carrying out the invention when taken in conjunction with the following drawings representing a preferred embodiment of carrying out the invention.

DETAILED DESCRIPTION OF THE PREFERRED EMBODIMENT

Figure 1:
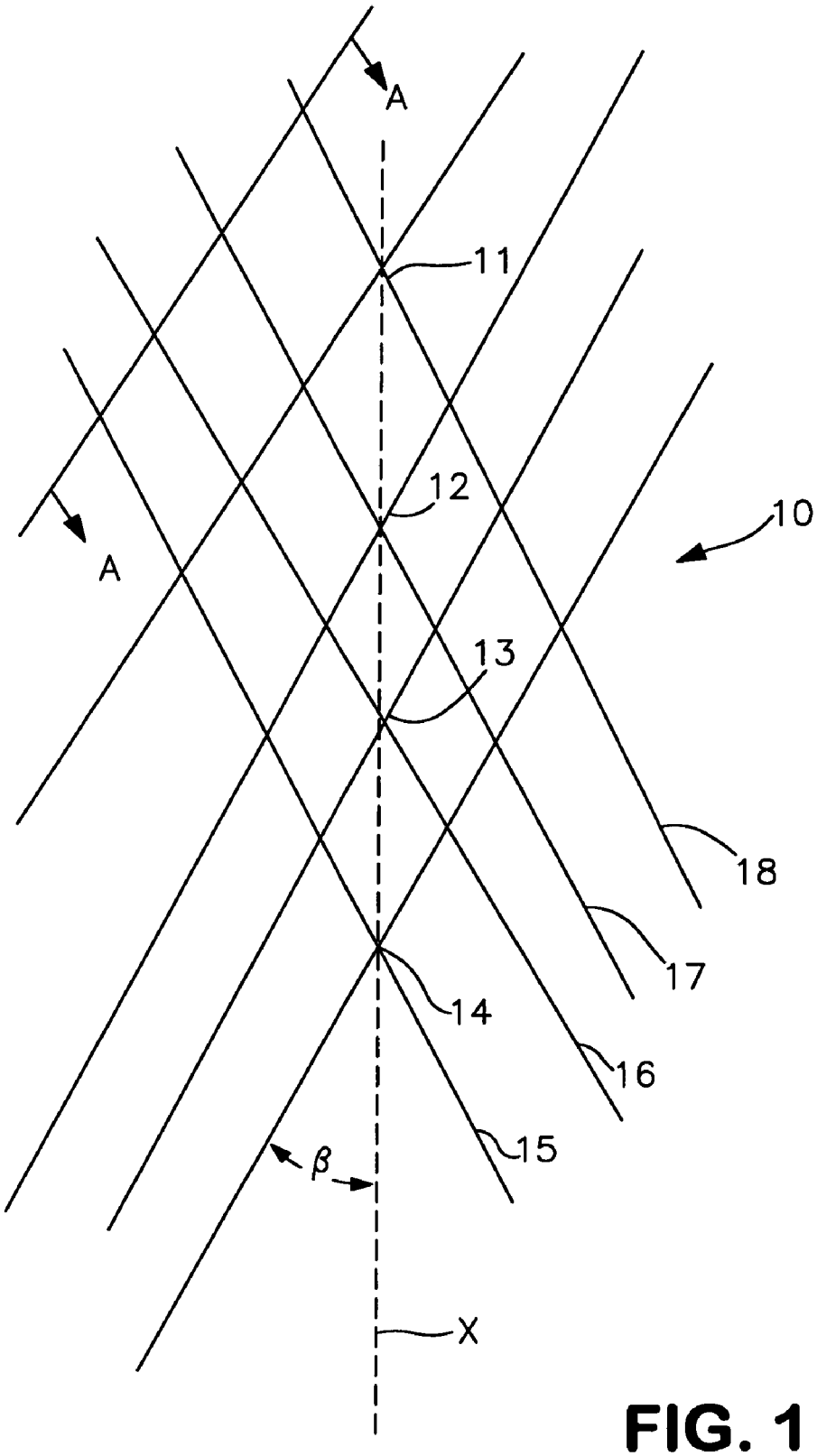
FIG. 1 PRIOR ART
FIG. 1 illustrates the figure 8 crossovers in the center of a partial coil of filamentary material wound in a figure 8 configuration in accordance with prior art winding techniques and wherein the crossovers are in the center of the coil.

By reducing the radial displacement of the figure 8s as the diameter of the wind increases during the winding of filamentary material, an increase in the density of the wind and, particularly, in the outer diameters of the wind, can be achieved when compared to prior methods of winding in the figure 8 configuration, i.e. constant radial spacing of the wind. For example by way of explanation, in a coil of filamentary material wound to a 21 inch diameter, if the radial spacing were maintained at 36 degrees separation, the coils will be approximately 2.4 inches apart along the circumference of the coil at a diameter of 8 inches. The circumferential coil spacing will be 4.8 inches when the coil diameter reaches a 16 inch diameter and 6.6 inches apart when the coil reaches 21 inches in diameter. The starting coil separation of 2.4 (36 degrees) inches for an 8 inch coil diameter can be reduced to an angular (radial) displacement of 13 degrees. This means that 27 figure 8s can be placed in the last layer. The difference in the wound length for that layer is significant. For constant ADVANCE the amount of filamentary material wound according to the prior art winding techniques mentioned herein, is approximately 110 feet, whereas with the programmed technique of the invention the amount of wound filamentary material is 297 feet.

Crossovers 11, 12, 13 and 14 are shown in the partial section of a coil 10 wound in a figure 8 configuration shown in FIG. 1 along a center line X of the wound coil. The angle β formed by the center axis X and the coils 15, 16, 17 and 18 is a function of the pattern of the figure 8 configuration, which in turn is a function of the traverse motion, the diameter to which the figure 8 pattern is being wound, and other factors. It is believed apparent from FIG. 1, that the smaller the angle β, then the less crossovers per layer of the wind, and conversely, the greater angle β is, the more crossovers per layer of the wind 10 This is because as angle β becomes smaller the spacing between the filamentary material becomes smaller. That is, the density of the wind decreases or increases in dependence on whether the angle beta is increased or decreased.

Figure 2:
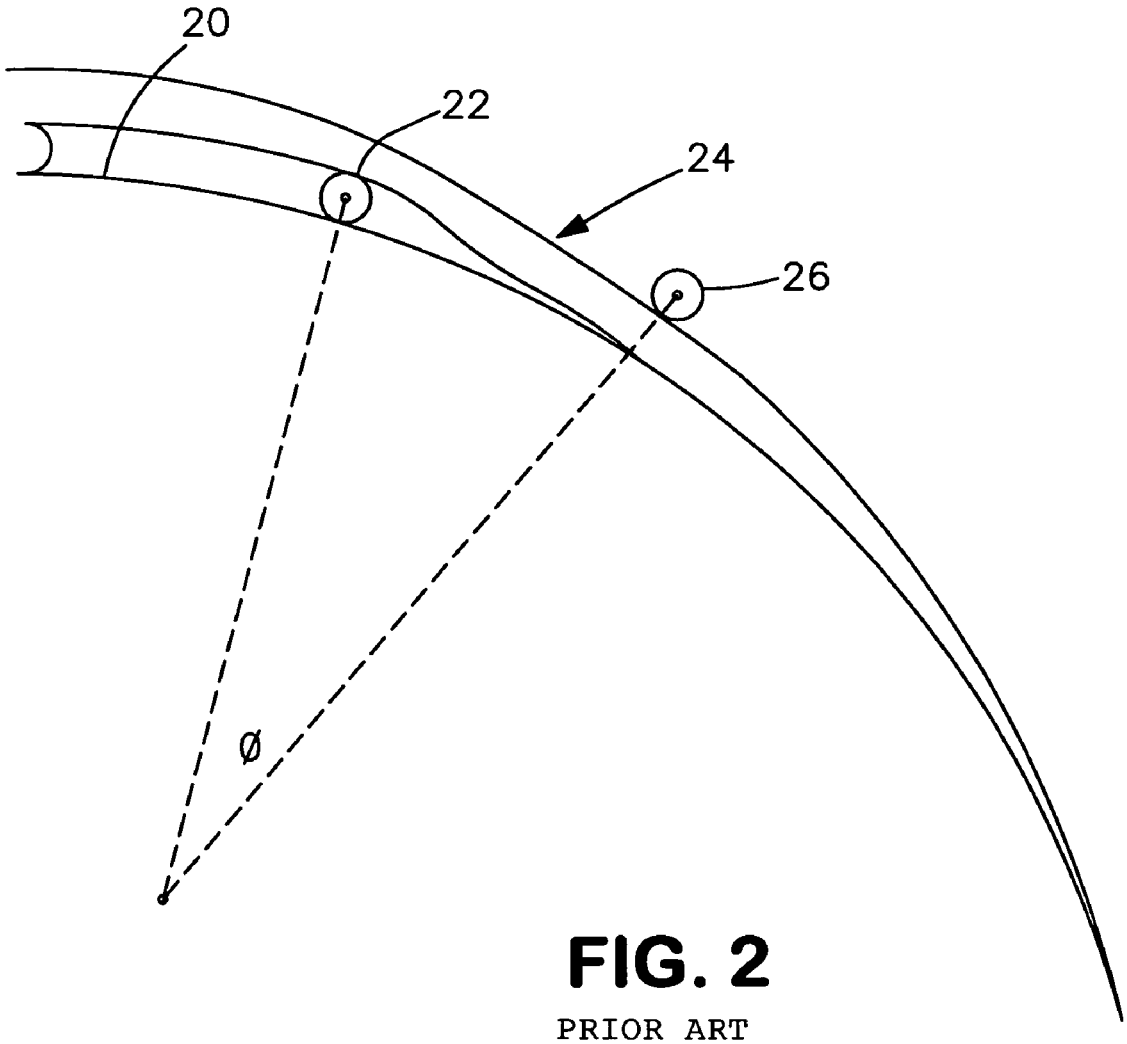
FIG. 2 PRIOR ART
FIG. 2 is a section of the partial coil of FIG. 1 taken along lines A-A of FIG. 1.
Figure 2A:
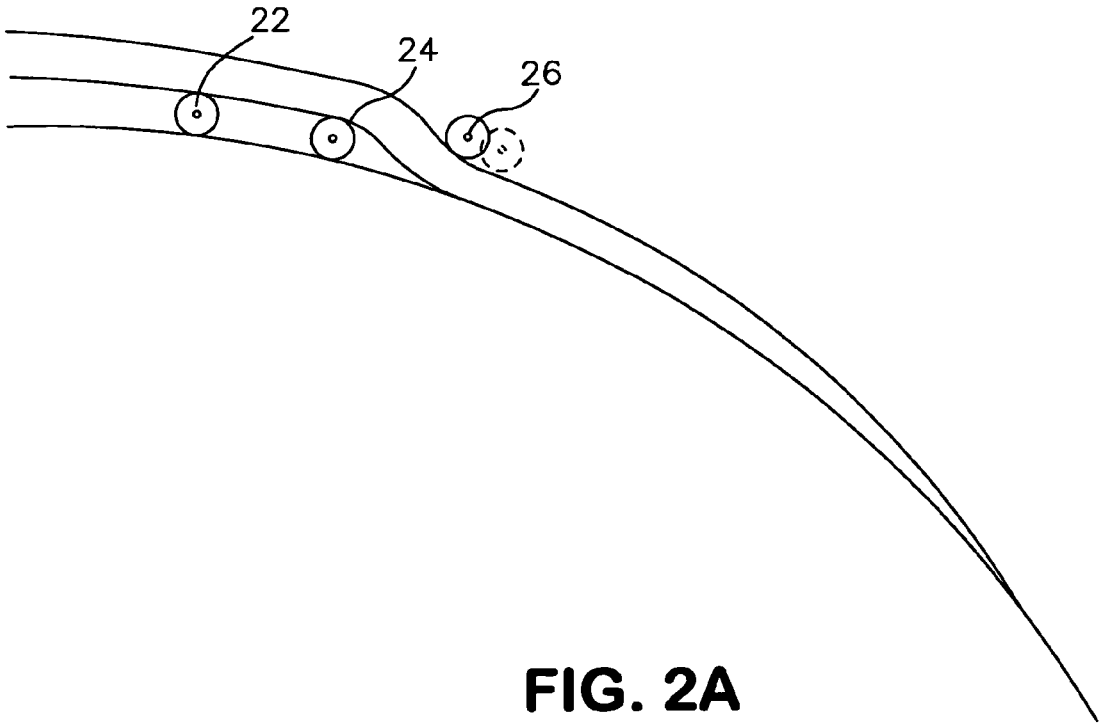
FIG. 2A PRIOR ART
FIG. 2A illustrates the extra bend in a partial coil of filamentary material due to the radial spacing of the coil in the winding process.

The section of the wound coil 10 of FIG. 1 along lines A-A shown in FIG. 2A shows mandrel surface 20 with the wound material 22 approaching out of the paper and returning into the page at 24. The next coil of filamentary material is shown approaching out of the paper at 26. The radial displacement ϕ is calculated by taking into consideration the need not to deform the wound material. Strand 26 is placed at a point where the strand 22 is already in contact with the surface 20 of the mandrel (or the layer below it if it is not the surface of the mandrel). If strand 26 were close to strand 22 (i.e. angle ϕ were decreased) strand 22 would have an extra bend in it as shown in FIG. 2B.

The angular displacement ϕ in FIG. 2*a* can be calculated from the equation (1):

$$\phi=\mathrm{COS}^{-1}(Rm/(Rm+D))$$

where: Rm=Radius of the mandrel

D=Diameter of the cable

Because the angle ϕ is viewed at a plane (Section A-A) other than the axis of the coil, it is adjusted by taking into account the angle β (FIG. 1). Angle β is a function of the shape of the pattern of the figure 8 configuration, which is, in turn, a function of the traverse motion, the diameter of the figure 8 wind, and other factors as mentioned above with respect to the description of FIG. 1. Therefore angle β can be almost any angle, but a typical angle would be approximately 24 degrees (This angle is typical of most industrial wire winding machines using an 8 inch mandrel). The displacement angle between figure 8s on the mandrel (individual coil layer) is then calculated by the equation (2):

$$\phi/\cos[24]=\phi$$

This angle is the minimum angle that is usually used to set the winding ADVANCE. Although the ADVANCE could be entered as an angular displacement, the usual entry parameter in the winding control system is in the form of a percent speed increase or decrease of the traverse motor speed when compared to the spindle motor speed of rotation. Therefore an UPPER RATIO could be a number such as 4.0%. It takes two spindle revolutions (720 degrees) to create one figure 8. This upper ratio of 4.0% then has the effect of advancing the traverse by 28.8 degrees for two revolutions of the spindle (720 degrees×0.040=28.8 degrees). A typical calculation to determine the minimum ADVANCE is as follows:

Rm=4 inches (Mandrel diameter assumed to be 8 inches)

D=0.242 inches

Therefore ϕ=19.447 degrees and the minimum figure 8 displacement on the mandrel would be 21.287 degrees. To create a 21.287 degree ADVANCE, the traverse must have a speed ADVANCE (plus or minus), when compared to the spindle, of 2.96% (or spindle to traverse ratio of 2 to 1.0296 and 2 to 0.9704, respectively).

To illustrate the effect of a density change as the coil diameter increases it is helpful to perform a simple calculation. Because in the above example, each figure 8 is displaced around the circumference by 21.287 degrees, there is room for 16.9 figure 8s in each layer if there were no payout hole (360 degrees/21.287 degrees). In coils with large payout holes, the size of the payout hole is approximately 90 radial degrees (i.e, greater than 80 radial degrees and often larger than 110 radial degrees). By removing figure 8s to accommodate the payout hole, (25% of them for 90 degrees is arbitrarily chosen for this example) the number of figure 8s is 12.675.

Each loop of the figure 8 is approximately the shape of a circle and because there are two loops per figure 8, each figure 8 is made up of approximately 4.189 feet on the surface of a typical 8 inch diameter mandrel (two loops times 8 inches×Pi/12). With 12.675 figure 8s per layer of the coil, the length of cable placed on the mandrel will be 53.093 feet (12.675 loops×4.189 feet). At the last layer of this exemplary wind, the coil is approximately 15 inches in diameter. Using the same number of figure 8s in this final layer, the length of cable wound is 99.549 feet.

In accordance with the method outlined herein, i.e. one that increases the number of figure 8s as the diameter of the wound coil increases, and by using formulas (1) and (2) for a layer diameter of 14 inches, 17.306 figure 8s can be placed in the last layer instead of 12.675 figure 8s without increasing the number of figure 8s as is the case with prior art figure 8 winding techniques. It is also noted that another benefit of the method of the present invention is that the diameter of the last layer is 14 inches instead of 15 inches. This enables the wound coil of filamentary material to be contained in a smaller package, thereby enhancing the storage transportability of the wound package and commensurately lowering the packaging costs.

The primary advantageous features of the invention reside in the fact that the same amount of filamentary material can be contained in a smaller container or package. Alternatively, a greater amount of filamentary material can be contained in a given size package. In the above example the length of filamentary material wound in the last layer is 126.855 feet which is over 27% more than with a wind in which the density of the figure 8s is not programmed as with the present invention. As a matter of fact all layers of the wound filamentary material after the first wound layer will have more wound material in it such that less layers are needed for a given length of desired wound filamentary material (Thus the 14 inch diameter instead of 15 inches).

Prior to the use of the programmed density method described herein, the ADVANCE(S) were constant throughout the winding of the coil of filamentary material (the plus and minus ADVANCE may not have been equal to one another, but once chosen, they remained unchanged throughout the winding of the coil). It is apparent that as the layers of filamentary material are wound upon each other, the radius R of the coil increases and the increase in radius can be calculated by knowing the diameter of the material being wound. It is evident that the coil radius for the strand 26 (FIG. 2A) is larger than the strand (22) by an amount equal to the diameter (D) of the filamentary material. By solving the equations 1 and 2 (by Computer), or by providing a "look-up chart" (in a computer) the ADVANCES can be reduced to an appropriate amount to maintain a figure 8 spacing that provides increased density while not adding extra bends in the wound material.

The accompanying Table illustrates the difference between the previous winding method and the programmed density approach of the present invention. The tabulations in the Table assume a 1000 foot coil of filamentary material that is 0.33 inches in diameter wound on an 8 inch diameter mandrel, using 21 inch endforms and a traverse width of 12 inches. The coil is wound using an average (of the upper and lower) ADVANCE that starts at 6.50%. This leaves 46.8 degrees between figure 8s and a distance, on the circumference of the mandrel, of 3.267 inches. These are not minimum numbers, but numbers that are likely to produce a good figure 8 coil with increased density and without bending of the filamentary material resulting in damage to it. Ratios that are too low will produce an uneven coil. In the Table the ratios are reduced from the average 6.50% to 1.30% by the time the coil reaches 21 inches. In this example the ratio never actually reaches the 1.3% mark because the coil never reaches 21 inches because of the effect of the density adjustment. In this example the ratios are reduced by 0.26% with each layer. This reduction rate is ultimately dependent on the cable diameter.

TABLE

| (1) Layer Number | (2) Layer Dia. | (3) No Density Programming Length/ Layer | (4) Cumulative Length | (5) Density Programming Length/ Layer | (6) Cumulative Length |
|---|---|---|---|---|---|
| 1 | 8 | 32 | 32 | 32 | 32 |
| 2 | 8.66 | 35 | 67 | 36 | 69 |
| 3 | 9.32 | 38 | 105 | 41 | 109 |
| 4 | 9.98 | 40 | 145 | 46 | 115 |
| 5 | 10.64 | 43 | 188 | 51 | 206 |
| 6 | 11.3 | 46 | 233 | 57 | 263 |
| 7 | 11.96 | 58 | 281 | 63 | 326 |
| 8 | 12.62 | 51 | 332 | 71 | 397 |
| 9 | 13.28 | 53 | 386 | 79 | 476 |
| 10 | 13.94 | 56 | 442 | 88 | 563 |
| 11 | 14.6 | 59 | 501 | 98 | 661 |
| 12 | 15.26 | 61 | 562 | 110 | 771 |
| 13 | 15.92 | 64 | 626 | 123 | 864 |
| 14 | 16.58 | 67 | 693 | 136 | 1034* |
| 15 | 17.24 | 69 | 762 | 158 | 1191 |
| 16 | 17.9 | 72 | 835 | 180 | 1372 |
| 17 | 18.56 | 75 | 909 | 208 | 1579 |
| 18 | 19.22 | 77 | 987* | 242 | 1821 |
| 19 | 19.88 | 80 | 1067 | 286 | 2107 |
| 20 | 20.54 | 83 | 1149 | 345 | 2452 |

By interpolation it is evident that the coil diameters differ by approximately 2.9 inches. Theoretically, at 20 inches the amount of filamentary material that can be wound using the programmed density method of winding is more than twice that which can be wound by the prior techniques or a coil of 1000 ft. could be 16.58 inches in diameter (layer #14) instead of 19.22 inches in diameter (layer #18) for the same length of filamentary material and using the programmed density techniques of the present invention. The ADVANCE started at 6.5% and finished at 3.38%.

Description of Typical Winding Machine with Programmed Density

Figure 3:
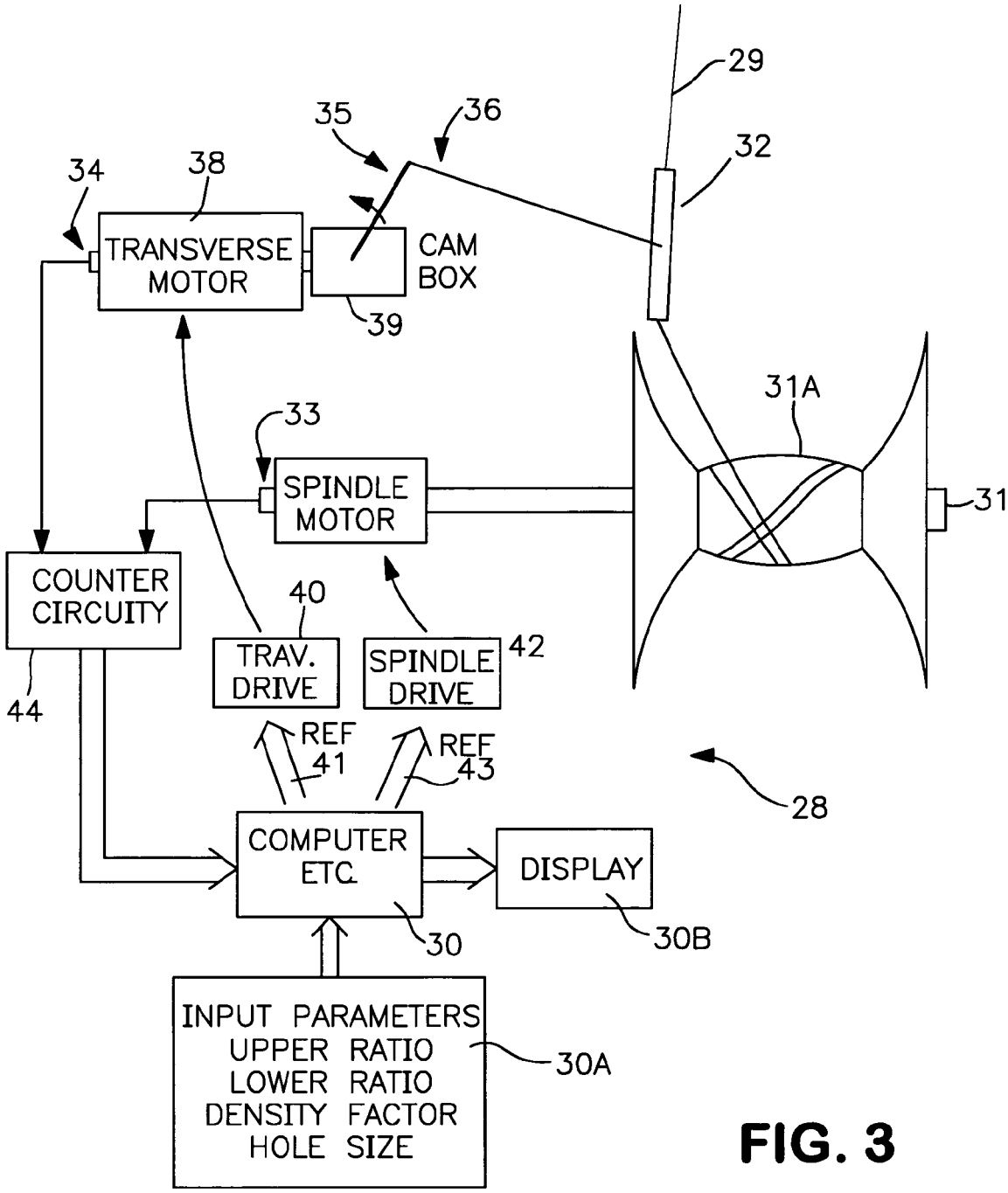
FIG. 3 shows, in block diagram format, a preferred embodiment of winding apparatus for carrying out the programmed density concept of the invention.

With respect to the block diagrammatic illustration of a winding machine 28 as shown in FIG. 3, computer 30 tracks the displacement of spindle 31 and traverse 32 usually with encoders 33 and 34, but other devices such as potentiometers or resolvers can be used. The necessary ADVANCES are entered either with an input device 30A such as thumbwheel switches, a keypad, computer keyboard, an internally stored data base, or downloaded from a database through serial communication (none shown in FIG. 3). The ADVANCES are calculated from the diameter of the filamentary material 29, the diameter of the mandrel 31A and the distance of the traverse 32 from the surface 31A of spindle 31. Various parameters of the winding process are displayed via display 30B.

The ADVANCES generally consist of two numbers-one for a plus ADVANCE and one for a minus ADVANCE and do not need to be equal. The computer 30 reads the position of the spindle 31 and traverse 32 and provides a reference signal 41 to the traverse motor 38 via the traverse drive 40 that results in an ADVANCE to the traverse 32. The computer 30 switches the sense of the ADVANCE (plus or minus) when it is time to make the payout hole in the winding. The aforementioned operations are known to those skilled in the winding art.

The spindle motor 33 is controlled by spindle drive 42 by a reference signal 43 from computer 30 in a manner known to the winding art.

The traverse 32 is driven with a simple crank arm 35 and connecting rod 36. When this arrangement of a crank arm 35 and connecting rod 36 is driven at a constant RPM (of the crank arm 36) by the traverse motor 38 and cam box 39, there is distortion created in the motion of the actual wire distributor (traverse 32). The cam box 39 normally uses an arrangement of cams to remove the aforementioned distortion.

The computer 30 receives input of the respective position of the traverse motor 38 and the spindle motor via encoders 34 and 33, respectively, through counter circuitry 44. The programmed density process in accordance with the invention is carried out by either programming the computer to solve equations (1) and (2) as defined above, or to provide a "look-up" table in the computer so that the necessary ADVANCES can be provided to the traverse motor 38 and/or the spindle motor 33.

The actual physical layout of the winding machine 29 is of no importance to the present invention as there are numerous ways of building a winding machine depending upon what features are most desirable. For example, mechanical cams provide the most speed. Dual and single belt traverses have other advantages. Electronic cams can provide a certain amount of flexibility, but have speed limitations. For example, electronic cams can be used to wind standard spools, but the method described herein does not apply to spools. A screw and a nut arrangement can provide high accuracy but has a serious speed limitation. DC motors can be used as well as AC motors, steppers or servos. The traverse 32, if driven by a mechanical cam, can be driven with a standard rotary motor (DC, AC, stepper, servo). Electronic cams can use a servo motor or linear motor. No matter what the details of the winding machine 29 are, the process of density compensation of the invention is the same.

Figure 4A:
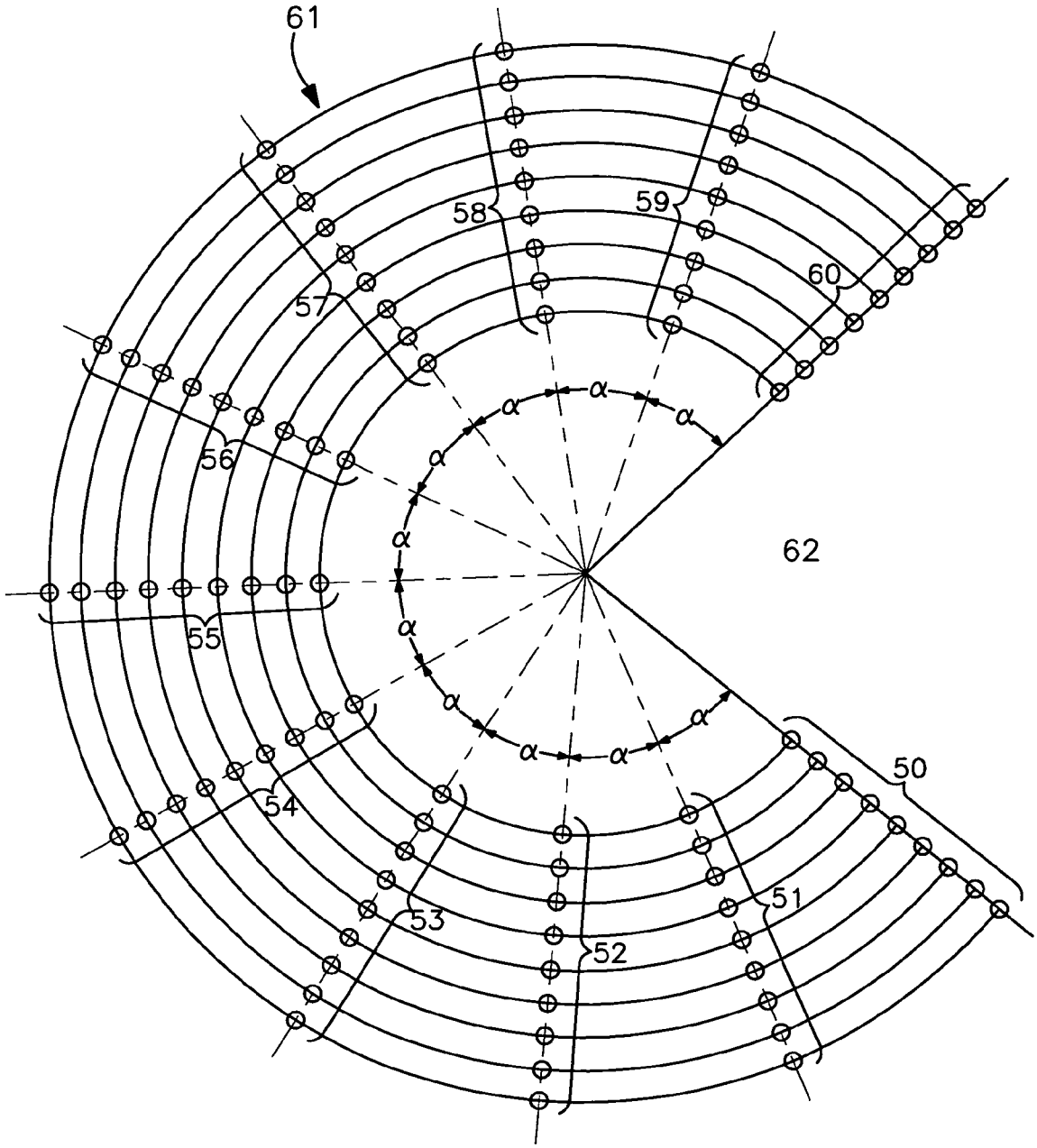
FIG. 4A PRIOR ART
FIGS. 4A and 4B, respectively show (1) a cross section of a package of filamentary material wound according to prior art winding techniques using non-programmed winding, i.e. constant angle spacing of the crossovers of the coils in the package of wound filamentary material; and (2) a cross section of a package of filamentary material wound according to the programmed density teachings of the present invention, i.e. programmed radial spacing of the figure 8 crossovers.
Figure 4B:
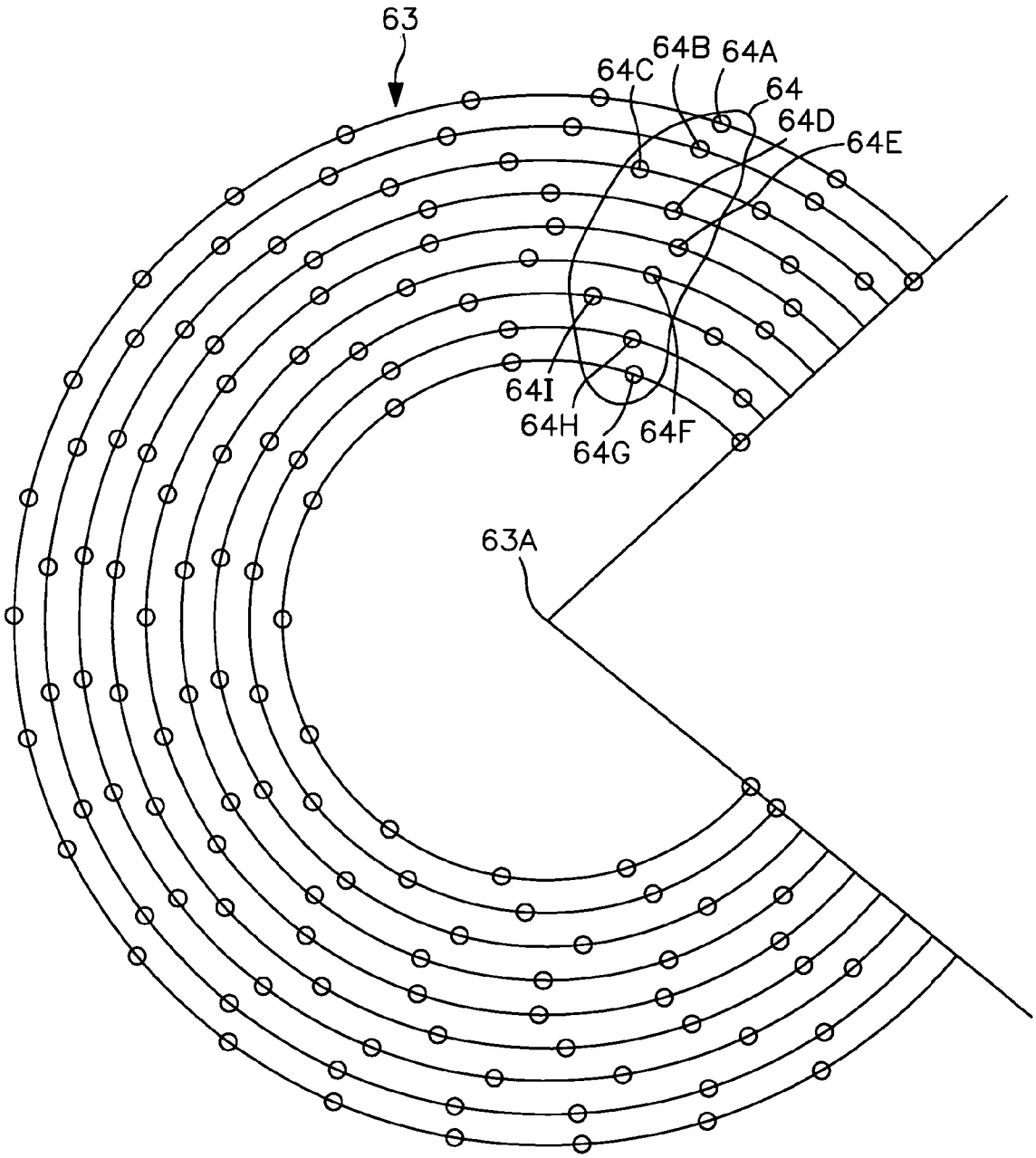

FIGS. 4A and 4B, respectively show: (1) a cross section of a package of filamentary material wound according to prior art winding techniques using non-programmed winding, i.e. constant angle spacing of the crossovers of the coils in the package of wound filamentary material; and (2) a cross section of a package of filamentary material wound according to the programmed density teachings of the present invention, i.e. programmed radial spacing of the figure 8 crossovers.

With respect to FIG. 4A, it is evident that without programmed density control, the angle alpha between adjacent crossovers 50-51, 52-53, 54-55, 56-57, 58-59 and 59-60 is a constant angle. That is in the prior art winding techniques using non-programmed density control, the crossovers in a given group of crossovers (for example crossovers within group 50), are aligned with one another. It is also evident from FIG. 4A that the crossovers are spaced circumferentially further apart as the diameter of the wind 61 increases. This results in an effective decrease in the density of the wound coil as the diameter of the coil increases. The priort winding technique produces a payout hole 62 as shown in the FIG. 4A in a region devoid of crossovers.

The crossover "pattern" 64 of individual crossovers 64A-64I (all inclusive) is formed in a package 63 of filamentary material wound in a figure 8 configuration and wherein the number of crossovers of the filamentary material in succeeding layers from the center 63A of the package 63 increase so that the density of the wound coil increases with increasing diameter of the package, whereby the length of material wound for a given diameter of the package of wound material, is greater than if the number of cross-overs remained aligned as in the package 61 of FIG. 4A. Unlike the package of FIG. 4A, formed by a non-programmed density winding technique and wherein the crossovers in successive layers of the wind are aligned, it is apparent that in the embodiment of the invention represent by FIG. 4B, the crossovers 64A-64I are "scattered", i.e. they are not aligned. This non-alignment of the crossovers in a wound package of filamentary material enables the wound package to be more dense, and thereby the same length of filamentary material can be wound in a smaller diameter, or alternatively a greater length of filamentary material can be wound with a lesser diameter than that formed by a prior art winding technique not using the programmed density winding technique of the present invention.

Therefore, it is desired that the present invention not be limited to the embodiments specifically described, but that it include any and all such modifications and variations that would be obvious to those skilled in this art. It is our intention that the scope of the present invention should be determined by any and all such equivalents of the various terms and structure as recited in the following annexed claims.

What is claimed is:

1. Apparatus for winding filamentary material in a figure 8 configuration, comprising:

a rotatable spindle for retaining a mandrel upon which the filamentary material is wound;

a traverse mechanism for controlling the laying of wound coils on the mandrel;

means for controlling the wound layers on the mandrel in accordance with the rotation of the spindle and the movement of the traverse mechanism to vary the angular displacement, radial displacement between successive coils, of the wound coil so that the number of cross-overs of succeeding layers of the wound coils increases as the winding process progresses, the advance of the wound coil, thereby increasing the density of the wound coils;

wherein the advance, $\phi_1$, is determined from the following equations to determine the angular displacement of the coil:

$$\phi=\mathrm{COS}^{-1}(Rm/(Rm+D)); \quad (1)$$

and where: Rm=Radius of the mandrel;

D=Diameter of the filamentary material; and $$\phi/\cos[24]=\phi_1 \quad (2).$$

2. Apparatus according to claim 1, wherein the means for controlling includes a look-up table for determining the advance of the wound layers.

3. Apparatus according to claim 2 wherein the means for controlling the advance of the wound layers produces a radial hole in the wound coil extending from the innermost layer of wound material to the outermost layer.

4. Apparatus according to claim 1, wherein the means for controlling is responsive to at least upper and lower ratio advances, desired density and hole size as winding control factors.

5. Apparatus according to claim 4 wherein the means for controlling the advance of the wound layers produces a radial hole in the wound coil extending from the innermost layer of wound material to the outermost layer.

6. Apparatus according to claim 1 wherein the means for controlling the advance of the wound layers produces a radial hole in the wound coil extending from the innermost layer of wound material to the outermost layer.

7. A process for winding filamentary material in a figure 5 configuration, comprising:

rotating a spindle retaining a mandrel upon which the filamentary material is wound;

moving a traverse mechanism for laying of wound coils on the mandrel;

controlling the wound layers on the mandrel in accordance with the rotation of the spindle and the movement of the trayerse mechanism to vary the angular displacement, radial displacement between successive coils, of the wound coil so that the number of cross-overs of succeeding layers of the wound coil increases as the winding process progresses, the advance of the wound coil, thereby increasing the density of the wound coils; and wherein in the step of controlling the advance $\phi_1$, is determined from the following equations to determine the angular displacement of the coil:

$$\phi=\mathrm{COS}^{-1}(Rm/(Rm+D));$$

and where: Rm=Radius of the mandrel;

D=Diameter of the filamentary material; and $$\phi/\cos[24]=\phi_1.$$

8. A process according to claim 7, wherein the step of controlling includes a look-up table for determining the advance of the wound layers.

9. A process according to claim 8, wherein in the step of controlling the advance of the wound layers produces a radial hole in the wound coil extending from the innermost layer of wound material to the outermost layer.

10. A process according to claim 7, wherein the step of controlling includes using at least upper and lower ratio advances, desired density and hole size as winding control factors.

11. A process according to claim 10, wherein in the step of controlling the advance of the wound layers produces a radial hole in the wound coil extending from the innermost layer of wound material to the outermost layer.

12. A process according to claim 7, wherein in the step of controlling the advance of the wound layers produces a radial hole in the wound coil extending from the innermost layer of wound material to the outermost layer.

13. A package of filamentary material wound in a figure 8 configuration and wherein the number of crossovers of the filamentary material in succeeding layers increase so that the density of the wound coil increases with increasing diameter of the package, whereby the length of material wound for a given diameter of the wound material is greater than if the number of cross-overs remained constant and made by the process, comprising:

rotating a spindle retaining a mandrel upon which the filamentary material is wound;

moving a traverse mechanism for laying of wound coils on the mandrel;

controlling the wound layers on the mandrel in accordance with the rotation of the spindle and the movement of the traverse mechanism to vary the angular displacement, the advance of the wound coil, of the wound coil so that the number of cross-overs of succeeding layers of the wound coil increases as the winding process progresses, the advance of the wound coil, thereby increasing the density of the wound coils; and wherein in the step of controlling the advance $\phi_1$, is determined from the following equations to determine the angular displacement of the coil:

$$\phi=\mathrm{COS}^{-1}(Rm/(Rm+D));$$

and where: Rm=Radius of the mandrel;

D=Diameter of the filamentary material; and $$\phi/\cos[24]=\phi_1.$$

14. A package of wound filamentary material according to claim 13 wherein the wound filamentary material includes a radial hole extending from the innermost wound layer to the outermost layer.

* * * * *